US006680097B1

(12) United States Patent
Amberger et al.

(10) Patent No.: US 6,680,097 B1
(45) Date of Patent: Jan. 20, 2004

(54) EASILY REMOVABLE LABEL FOR REUSABLE CONTAINERS

(75) Inventors: Werner Amberger, München (DE); Christian Link, Holzkirchen (DE); Helmut Schönfelder, Thansau (DE)

(73) Assignee: Steinbeis PPL GmbH, Brannenburg (DE)

( * ) Notice: Subject to any disclaimer, the term of this patent is extended or adjusted under 35 U.S.C. 154(b) by 0 days.

(21) Appl. No.: 09/926,325

(22) PCT Filed: May 12, 1999

(86) PCT No.: PCT/EP99/03294

§ 371 (c)(1),
(2), (4) Date: Feb. 11, 2002

(87) PCT Pub. No.: WO00/62273

PCT Pub. Date: Oct. 19, 2000

(30) Foreign Application Priority Data

Apr. 14, 1999 (EP) ..... 99107508

(51) Int. Cl.[7] ..... G09F 3/10

(52) U.S. Cl. ..... 428/40.1; 134/10; 134/16; 156/94; 156/247; 156/344; 283/81; 428/41.5; 428/42.1

(58) Field of Search ..... 428/40.1, 42.1, 428/41.5; 156/250, 247, 344, 94; 283/81; 134/10, 16

(56) References Cited

U.S. PATENT DOCUMENTS 4,956,033 A * 9/1990 Martin ..... 156/94
5,262,216 A 11/1993 Popat et al.
5,651,846 A 7/1997 Hurst

FOREIGN PATENT DOCUMENTS

| | | |
|---|---|---|
| DE | AS 11 42 117 | 1/1963 |
| DE | 25 38 368 | 3/1977 |
| DE | 30 37 640 A1 | 5/1982 |
| DE | 37 20 267 C2 | 7/1989 |
| DE | 39 09 089 A1 | 9/1990 |
| DE | 43 28 016 A1 | 3/1994 |
| DE | 43 24 357 C1 | 11/1994 |
| DE | 43 39 680 A1 | 5/1995 |
| DE | 197 16 875 A1 | 11/1997 |
| EP | 0510403 A | 10/1992 |
| GB | 2259291 A | 3/1993 |

OTHER PUBLICATIONS

German Search Report, application No. 298 06 781.1 of Apr. 15, 1998.

* cited by examiner

*Primary Examiner*—Nasser Ahmad
(74) *Attorney, Agent, or Firm*—Rothwell, Figg, Ernst & Manbeck

(57) ABSTRACT

A self-adhesive film label, in particular for reusable bottles, is proposed which can be readily detached in conventional washing equipment. This is achieved by means of a self-adhesive label with a stretched film layer, which shrinks back at elevated temperature in the washing device. Since the adhesive of the label loses its adhesive force at this temperature, the label is rapidly and readily detached, supported by the surrounding washing liquid of the washing device.

55 Claims, 3 Drawing Sheets

EASILY REMOVABLE LABEL FOR REUSABLE CONTAINERS

DESCRIPTION

The invention relates to a label for an article, in particular for a reusable container, the backing material layer of the label being bondable onto the article by means of an adhesive layer and the label being removable from the article under the effect of heat, in particular in hot washing fluid or/and by thermal radiation. The articles may be beverage bottles or medicine bottles of glass or plastic, test tubes, repeatedly reusable outer packagings for a multiplicity of individual containers, in particular beverage bottle crates, etc.

BACKGROUND OF THE INVENTION

For example, in the beverage industry, the containers used, for example bottles, are subject to a high quota of reuse. The containers are cleaned with each return before refilling, the labels also being detached during washing of the vessels. Then the vessels are refilled and relabelled corresponding to the beverage type filled. If the vessels are standardised for a particular product group, such as a beer bottle, the bottles returning to the brewery do not need to be resorted according to beer types, as would be the case with permanently predecorated bottles. The different labelling usually only occurs after filling. In the case of a direct printing of the bottle which cannot be washed off, large warehouse stocks of the appropriate predecorated bottles would have to be held in readiness.

In the beverage industry the washing of the vessels, i.e. the bottles, is generally carried out with a hot washing liquid, such as dilute caustic soda, heated to 60 to 90° C., without additional mechanical support in the form of brushes, high-pressure nozzles etc.

Often, paper labels with wet-glue adhesive are used for the labelling of reusable containers. In this case, the wet-glue adhesive is applied to the full surface or in strips, the adhesive only being applied to the paper immediately before labelling. The disadvantage is that the filler must work with wet glue, that is to say contamination of the machine occurs and the handling of these labels is more difficult than that of self-adhesive labels.

This disadvantage is avoided by self-adhesive labels, which are obtained from the label suppliers already provided with adhesive. Because of the standardised washing-off conditions in the beverage industry, it was only possible to use paper-based labels until now. During washing off of the labels in the wash station, the water permeability of paper is exploited with the object that the wet-glue adhesive comes relatively quickly into full-surface contact with the washing liquid, and is completely detached in the predetermined washing time—of the order of some minutes, the adhesive however then usually going into solution in. the washing liquid. This high permeability for washing liquid and water is not possessed by the thermoplastic films used for many labels—such as polyolefins, polycarbonates, polyesters, polyvinyl chlorides, polystyrenes, etc. Such films prevent the access of the washing liquid to the interface of the adhesive and container surface, so that the impermeable film labels can only be slowly detached from the label edge, which, without additional mechanical support, such as brushes, high-press nozzles, etc., does not permit complete removal of the labels within an economically justifiable time span. These mechanical means are undesirable because of the higher outlay.

In the case of a paper/wet-glue label, the adhesive swells and is then detached. In the case of paper labels precoated with adhesive, redispersible adhesives are also used. In addition, there are particular paper types that quickly disintegrate.

In particular in the beverage industry, however, there is an increasing demand for film-based labels precoated with adhesive. Such film labels, in contrast to paper labels, can be decorated in an extremely wide range of ways. In contrast to paper, they are also available in transparent form, have wet strength and can be dispensed onto the containers at high speed in standardised machines, without the need to work with adhesives, as for example in the case of the wet-glue paper label. Their mechanical properties such as tensile strength and extensibility are greatly superior to those of paper labels. However, it should also be possible to readily wash off such film labels with existing washing systems as easily as the paper labels often used until now.

In order, nevertheless, to be able to use film-based labels for reusable beverage bottles, label systems have now been developed, which permit complete removal of the labels after each return. In the so-called Contiroll system, the all-around labels are not full-surface adhesively bonded. Adhesive spots between the label and container surface are only provided in the region of the overlapping joint. To detach the label, the labels are slit in the axial direction of the container. In this process the container can easily be damaged. Furthermore, the slitting devices require high outlay. This system does not allow labelling over only a partial circumference of a bottle, since no continuous adhesive is present. Such all-round labels may be displaced on the container and foreign matter may penetrate between the label and the container surface, so that these labels do not come into consideration for so-called "no-label look" applications, that is to say for applications in which, through the use of highly transparent film materials, the labels allow a view of the bottle or contents at the places where the label is unprinted.

Also known are so-called "sleeve labels" of shrinkable film. A film tube is slipped over the container and then shrunk on by the application of heat. Adhesive bonding between the label and container is entirely absent in this case. For removal, the label must in this case be elaborately slip open. A further disadvantage of these labels is that no enhanced decoration such as metallic effects or embossed sheet printing is possible, since these sleeves are printed directly from behind by reverse printing, and such enhanced decorations are not shrinkable to the same degree as the printed film substrate. In this case displacements and loss of brilliance would occur. Furthermore, both the last-mentioned labelling systems are material-intensive, since complete all-round decoration of the object is always necessary.

The object of the invention is therefore to provide a label of the type mentioned at the outset, which can be detached again from the article with little effort.

SUMMARY OF THE INVENTION

This object is achieved in that this label is characterised in that the backing material layer comprises a plastic film layer that is stretched in at least one direction and shrinks back under the effect of heat, for example the temperature of the washing fluid or/and by thermal radiation, so as to overcome the retention force of the adhesive layer.

By virtue of the effect of heat, shrinking back of the plastic film occurs, while at the same time the adhesive loses adhesive force. By this means, the label detaches gradually from the article, for example from the edge or with the formation of channels, and can be easily removed within an extremely short time.

The hot washing fluid by be in the form of a liquid, gas or vapour, or a mixture thereof and contain surfactants and lyes, in particular caustic soda. In the case of thermal radiation, infrared radiators or else other radiators with an infrared component may be used. The labels are detached particularly quickly under the combined effect of hot washing liquid and thermal radiation.

If a washing liquid is used as washing fluid, it can penetrate to the adhesive even faster from the edge or through the channels, and detach the adhesive in an extremely short time. The adhesive may be such that it is not substantially detached under the effect of pure water, however detaches relatively quickly from the container under the effect of the washing liquid, for example 1–2% hot caustic soda, which is conventionally used in the beverage industry.

Preferably the shrinking force of the film layer and the bonding effect of the adhesive are matched to one another such that the label can be completely detached from the container at a temperature of more than 50° C., in particular more than 60° C., over a duration of 10 sec. to 15 min., in particular 3 to 6 min., under the effect of the washing liquid. These are typical washing conditions in conventional bottle washing systems in the beverage industry.

Preferably the decrease of the bonding effect of the adhesive is based on a decrease of its viscosity with the heating of the label during the washing process.

Preferably the retention force of the adhesive towards the label is chosen higher than the release force effected by shrinkage of the plastic film layer, so that with detachment of the label from the article the adhesive layer remains on the label and can be removed from the washing liquid and disposed of together with the label, for example by means of a simple sieve. By this procedure it is also achieved that adhesive cannot accumulate in the washing liquid.

The adhesive is preferably one that does not dissolve in water, at least until detachment of the label, in particular a redispersible adhesive such as a dispersion adhesive based on acrylate or copolymeric acrylate/polyurethane compounds and copolymers with an acrylate proportion (e.g. rubber/acrylate).

Preferably the adhesive is applied to the label material covering the full surface or in regions with gaps, if appropriate in patterns. The full-surface application permits a design as a so-called "no-label look" label, which, at places where it is unprinted, allows a view through to the product. In the case of adhesives applied in regions, i.e. in a shaped manner, the appearance is usually disturbed.

The adhesive layer may also be a hot-melt adhesive or a glue or a radiation-curing or thermally melting adhesive applied to the article or to the label immediately before labelling.

Preferably the label serves for adhesion to a cylindrically curved surface of the article, such as a beverage bottle, its stretching direction or—in the case of biaxially stretched film material—its main stretching direction extending in the circumferential direction of the container or transverse to, in particular perpendicular to, the circumferential direction of the container. In the case of plastic films, it may be a single monoaxially or biaxially stretched plastic film layer, or a plurality of plastic film layers whose respective stretching directions or main stretching directions are often essentially identical. In this case the plurality of plastic film layers may be coextruded or manufactured individually and bonded to one another by means of lamination adhesive. Both film layers may be shrinkably stretched in the same direction or in crossing directions to the same or different extents, the more weakly shrinking film layer in the label laminate coming preferably to lie at the bottom, that is to say at the side facing the adhesive layer. The two film layers can be bonded to one another by means of lamination adhesive.

Furthermore, it is possible to use a shrinkably stretched film for only one of these film layers, in particular the lowermost film layer, and for the others to use a non-shrinking film, i.e. a thermally fixed, dimensionally stable film. In this case, the two film layers can also be bonded to one another by means of lamination adhesive, i.e. a one or two-component lamination adhesive such as a polyurethane-based adhesive, and pressure-sensitive adhesives or else thermally activatable adhesives.

It is possible that the (main) stretching direction and therefore the (main) back-shrinking direction of the plastic film(s) extends in the circumferential direction of the cylindrical container, so that shortly before the complete detachment the label only adheres to the container in the vicinity of a line. Another possibility consists in arranging the (main) stretching direction of the plastic film(s) transversely to the circumferential direction of the container, so that, shortly before complete detachment, the label only adheres to the container in the vicinity of a point.

Preferably the degree of shrinkage of at least one plastic film layer—at least in the main shrinkage direction—under heating to one of the above-mentioned temperatures is in the region of ≧5%, in particular ≧10%, more particularly ≧15–20% or more.

The plastic film layer is preferably made from monoaxially or biaxially stretched polyethylene terephthalate (PET) film or polyvinyl chloride (PVC) film, which shows a high degree of shrinkage.

To ensure that during and after washing off, the adhesive remains bonded to the label and can be easily disposed of, the label layer bearing the adhesive can be treated before application of the adhesive bonding agent, for example by corona treatment, flame pretreatment, plasma pretreatment or chemical grafting or with the aid of an adhesion-promoting intermediate layer containing, for example, chlorinated polyolefins, chlorinated rubber, ethylene/vinyl acetate (EVA) copolymer, chlorinated polypropylene or polymerised ethylene/acrylamide comonomers.

The label according to the invention can have the above-mentioned advantages over conventional paper labels and at the same time fulfil three main requirements:

1. The label can be washed off in conventional industrial washing systems
2. The washing liquid accumulates neither adhesive nor film components, since these can be filtered out in an extremely simple manner by means of a sieve.
3. The film label can be detached from the article as an entirety together with the adhesive bonding thereto, leaving no residues.

BRIEF DESCRIPTION OF THE DRAWINGS

The invention will now be explained in greater detail below by means of typical embodiments, with reference to the accompanying drawings, wherein FIG. 1 schematically shows the detachment of a label according to the invention on a cylindrically curved article under the effect of heat.

DETAILED DESCRIPTION

Figure 1:
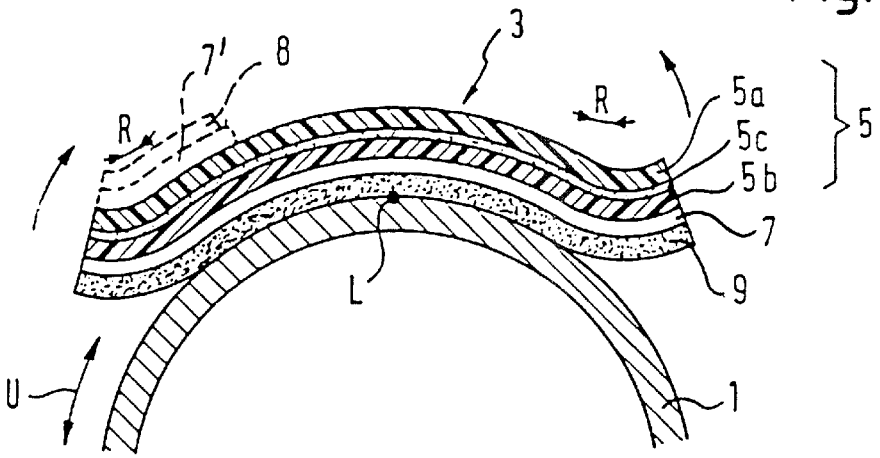
FIGS. 1*a*, 1*b* and 1*c* show variants of FIG. 1

FIG. 1 schematically shows a partial section taken perpendicular to the axis, through a cylindrical container 1, such as a beverage bottle, on whose circumferential surface a self-adhesive label 3 is bonded. The label 3 has on its top side at least one shrinkable plastic film layer 5, which is stretched at least in the circumferential direction and is directly printed on its underside by means of an overprint layer 7, which if appropriate may only be present in partial regions of the surface of the film layer 3. The film layer 5 may bear an overprint 7' on its top side, which in turn may bear a protective layer 8, for example in the form of a lacquer or laminated film. At the bottom, the label 3 has a pressure-sensitive layer 9. Under the effect of hot, in particular basic washing liquid with about 1 to 2% of NaOH, at about 50 to 90° C., the top cover layer 5 shrinks preferentially in the main stretching direction of the label, that is to say in the circumferential direction U of the vessel 1, as is shown in FIG. 1 with the arrows R. At the same time, the viscosity of the adhesive layer 9 is depressed such that the label 3 begins to detach, starting from the edge, in the circumferential direction of the vessel. This facilitates the access of the surrounding washing liquid to the adhesive 9, which further accelerates the detaching process. Shortly before the complete detachment, the label adheres only in the region of a line L, which corresponds to a generatrix of the circumferential surface of the container 1. In the case of a gently curved or uncurved container surface, channel formation may also occur between the adhesive label and container surface to facilitate the access of the washing liquid to the adhesive layer.

The stretching direction of the film layer 5 does not necessarily agree with the circumferential direction U of the container. The reason for this back-shrinking process of the film layer 5 lies in the fact that monoaxially or biaxially oriented, non-thermally-fixed films stretched in this manner possess a "frozen-in" internal stress state of their molecules, which leads to a reverse orientation of the molecules on the supply of heat, i.e. to shrinkage of the film layer in the direction R, in which they were previously stretched. This is also known as the memory effect.

The thermoplastic films preferably used here are insoluble in the washing liquid or in water, however they may possess a certain tendency to swell. Single-layer films as well as multilayer film laminates 5*a*,5*b* may be used, either in the form of coextrudates or film laminates, i.e. films laminated together. FIG. 1 shows such a laminate with an external, top film 5*a*, which is bonded by means of a lamination adhesive layer 5*c* to a lower film 5*b*. The individual film layers of coextrudates or laminates may have the same or different degrees of shrinkage. In the case of coextruded films 5*a*, 5*b*, the lamination adhesive layer 5*c* is missing.

In the case of different degrees of shrinkage of the individual layers, the layer 5*b* facing the container preferably shrinks less strongly than the layer 5*a* facing away from the container. The layer 5*a* or the layer 5*b* may also be dimensionally stable, that is to say essentially not shrink at elevated water temperature. Thus, as a result of the different shrinkage behaviour of the individual layers 5*a,b*, a type of "bimetallic" effect is produced, which leads to the label edges detaching first from the container or/and, depending on the degree of shrinkage of the one or plurality of films and the shrinkage direction with respect to the container surface, in addition to the above-mentioned channel formation, which also allows the accelerated access of the washing liquid to the adhesive.

Figure 1A:
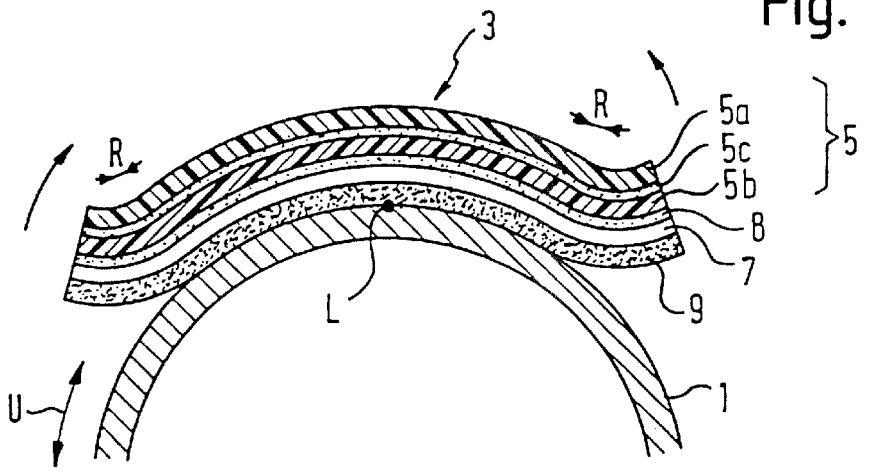

FIG. 1*a* shows a variant of FIG. 1 in which the overprint 7 is not printed directly on the underside of the film layer 5, but with the interposition of an adhesion promoter layer 8, for example an acrylate layer (top coating). If, in contrast to FIG. 1*a*, the overprint 7 is printed from the top onto film layer 5, as is designated 7' in FIG. 1, an adhesion promoter layer may also be located between the overprint 7' and the film layer 5. The overprint 7' may be covered by means of a protective layer 8, such as a protective layer or a laminating film.

Figure 1B:
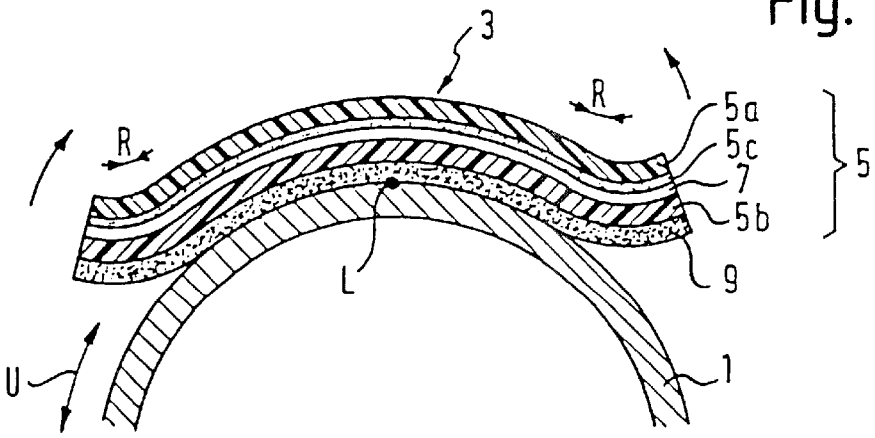

As shown in FIG. 1*b*, the overprint 7 may also be enclosed between two film layers 5*a*, 5*b*. The lamination adhesive 5*c* may, as shown, be located between the overprint 7 and the top film layer 5*a*. Alternatively, or additionally, the lamination adhesive layer may also be located between the overprint 7 and the lower film layer 5*b*.

Figure 1C:
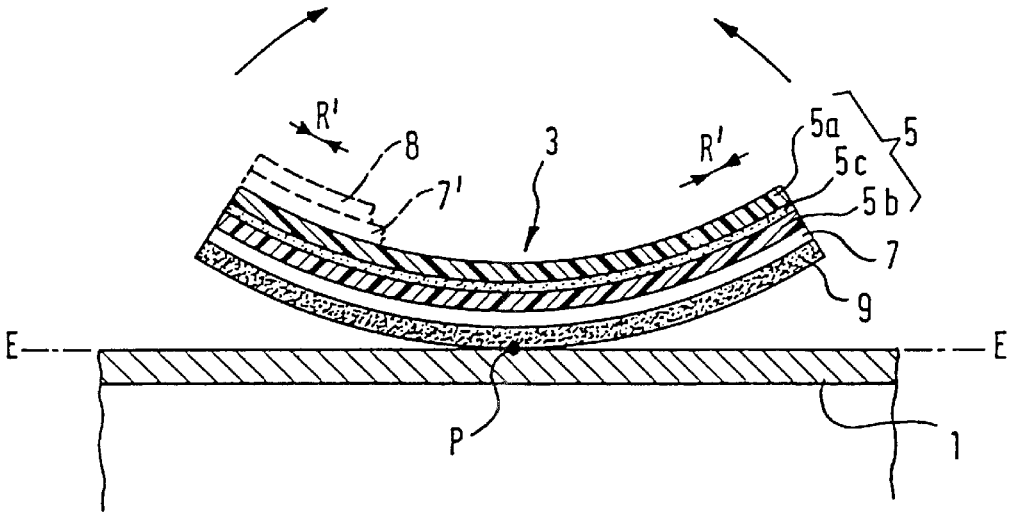

FIG. 1*c* shows a variant with the same layer structure as FIG. 1, but the main stretching direction R' of the label extending transversely to the circumferential direction, in this case parallel to the generatrix E—E of the cylindrical circumferential surface of the label. Shortly before complete detachment, the label adheres only in the region of a point P on the circumferential surface of the container 1. Labels with the structure of FIGS. 1*a* and *b* can also be used for this.

In the case of film laminates, in which two or more film layers are laminated together, the orientation direction of the individual layers may be the same or different, that is to say both in the machine direction during the production of the film tape and transversely thereto. It is essential that the shrinking force of the films overall under the given washing-off conditions is higher than the adhesive force between the adhesive and container surface.

Figure 2:
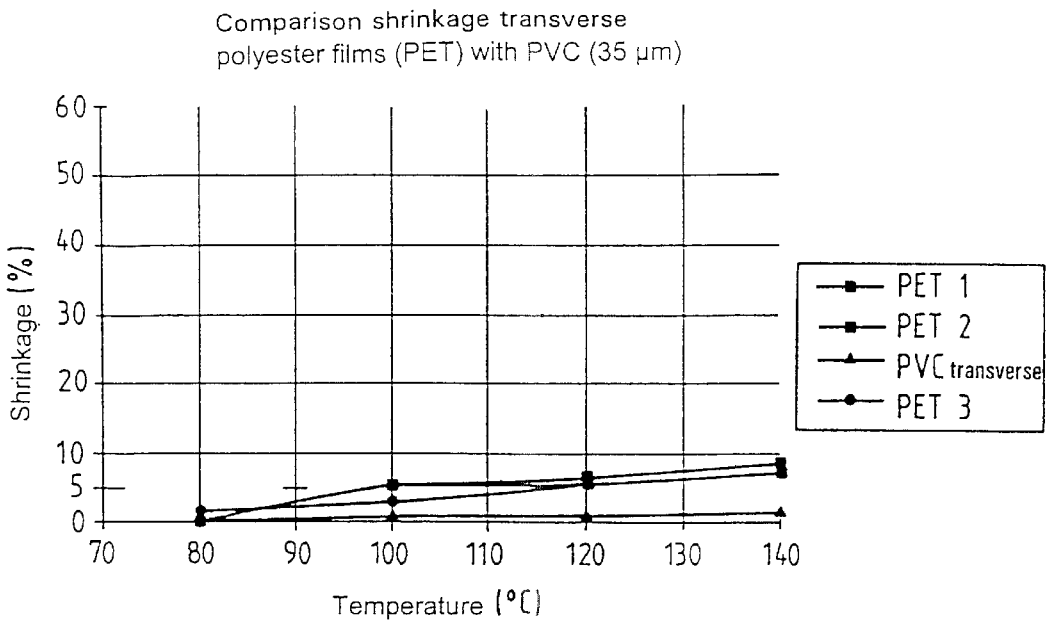
FIG. 2 shows a graph of the transverse shrinking behaviour of different monoaxially stretched polyester films in comparison to a PVC film (thickness 35 $\mu$m in each case), and FIG. 3. shows a graph of the longitudinal shrinking behaviour of the polyester films and the PVC film from FIG. 2.
Figure 3:
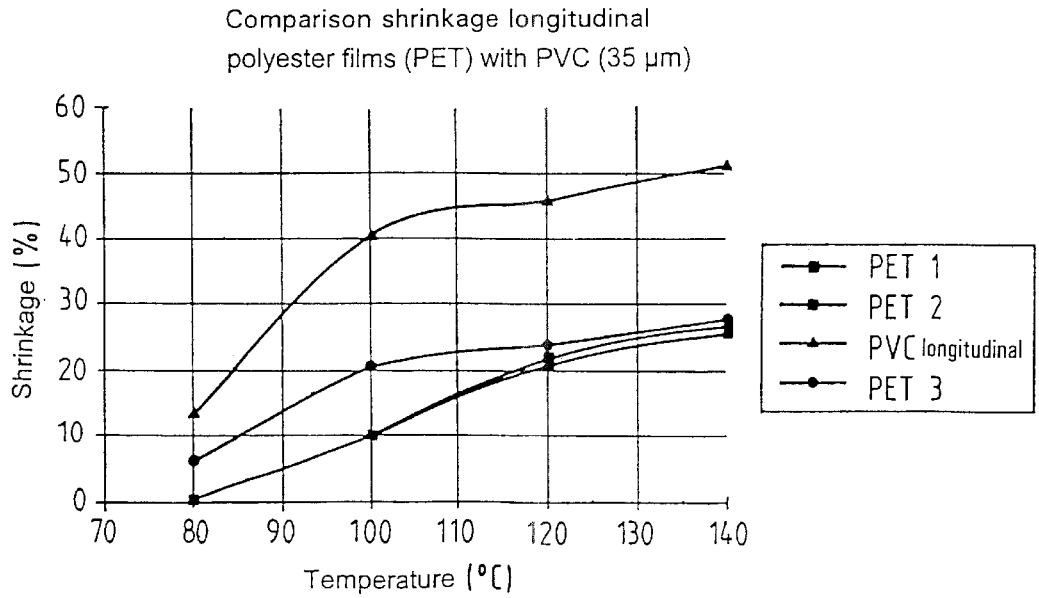

The preferred temperature ranges, in which films which are appropriate in this context shrink, start above 40° C., in particular in the range from 60 to 90° C., in which bottle washing systems conventional in the beverage industry operate. The shrinkage of such films should under these washing conditions be at least 5% in the main shrinkage direction, preferably 15 to 20% or more. Examples of such films are in particular monoaxially or biaxially stretched shrinkable PET or PVC or polyester films or else other shrinkable films, such as polyethylene, polypropylene, polyolefin, acetate or COC (cycloolefin copolymer) films or others, as well as mixtures of one or more of these film materials in thickness ranges from 10 to 200 $\mu$m, preferably however in the thickness range from 30 to 100 $\mu$m. Examples of possible films and their shrinkage behaviour can be derived from FIGS. 2 and 3. A comparison of FIGS. 2 and 3 shows that, in the case of monoaxially shrunk films, the transverse shrinkage behaviour (FIG. 2) at 90° C. for all the tested PET and PVC films is below 5%, whereas the longitudinal shrinkage (FIG. 3) at 90° C. of the tested PET films is significantly more weakly pronounced than in the case of PVC film, which here reaches almost 30% at 90° C. For the present application, PVC film is therefore preferred, since it shows a particularly high shrinkage force at the temperatures conventional in washing systems.

The shrinkage, the time until detachment of the label and the associated temperature are mutually interacting effects.

Thus, for example, a PVC film requires less than 3 min. at 80° C. and over 5 min. at 70° C. until the shrinkage leads to complete detachment of the label from a glass surface.

The adhesive does not dissolve in the washing liquid during the washing process, but detaches from the container together with the label film, the washing liquid thus does not accumulate dissolved adhesive. This is achieved, for example, by using a readily dispersible adhesive, such as aqueous acrylate dispersions or other adhesives with a high proportion of dispersion aids or emulsifiers. It is also appropriate to use adhesives based on water-soluble or water-swellable binders or adhesives formulated by means of such auxiliaries or water-insoluble adhesives or adhesives not swellable in water, but whose adhesive force is so low that the shrinkage force of the film is sufficient for detachment. In general it is suitable to use all dispersion adhesives, all adhesives made redispersible by means of additives, all adhesives in which binders or formulation agents have been made readily dispersible by means of structural modifications (different copolymers or copolymers changed in their quantitative composition or copolymers changed in their sequence), all adhesives based on water-soluble or water-swellable backbone binders (such as acrylates, polyvinyl alcohols or their esters, glues, polyglycolic acid, polylactides, polyethylene glycols and various polyamides, polyesters, etc.). In the selection of adhesives based on water-soluble backbone binders, however, there is a restriction in the time period of dissolution of adhesive in the washing substance. In order that complete dissolution of the adhesive does not take place during the washing process, the water solubility of these adhesives must be adjusted such that water dissolution only takes place from an action time of the washing substance of usually more than 10 min., that is to say only after detachment of the label. In this case it may be a pressure sensitive or a thermally sensitive adhesive. The adhesive can be applied over the full surface or partially, for examples in strip or punctiform application or in other patterns.

Alternatively, solvent adhesives, for example based on natural or synthetic rubber, for example based on styrene-butadiene-styrene (SBS) block copolymers, or styrene-isoprene-styrene (SIS) block copolymers, or acrylates and acrylate hot-melt adhesives, and radiation-curing adhesives, for example UV or electron-beam-curing adhesives, for example based on acrylate or rubber.

To ensure that the film and adhesive and the overprint layer 7 located if appropriate between the film 5 and adhesive 9 can be detached in a connected manner from the container leaving no residue, the relative bonding force—the adhesion force between the film and adhesive and their adhesion force to the overprint layer which may lie between them—must be greater at every phase of the washing-off process than the absolute bonding force, namely the adhesion force between the adhesive and container surface. This is achieved by means of an appropriate composition of the adhesive and corresponding surface pretreatment of the film and, if appropriate, of the container. The pretreatment of the film surface before the adhesive coating is preferably carried out by corona treatment. However it may also be flame pretreatment, plasma pretreatment or chemical grafting. To ensure optimum bonding of the adhesive on the film, which is in all cases greater than the adhesion of the adhesive to the container, an adhesion promoter may also be used between the film and adhesive layer, for example an adhesion promoter based on low molecular-weight, chlorinated polyolefins or a composition of chlorinated rubber (20 to 60%, chlorine proportion 60%), EVA copolymer (40 to 80%; 25% VA) and chlorinated polypropylene (1 to 15%; 25 to 50% chlorine) or an adhesion promoter of ethylene/acrylamide comonomers, which cure by polymerisation.

By this means, it is also achieved that the adhesive, under the viscosity-depressing effect of the hot washing liquid, remains so stable that the adhesive layer is not cohesively destroyed. This is achieved in particular when the cohesion of the adhesive under the particular washing conditions is greater than the adhesion between the adhesive and container surface.

If the overprint layer 7 is still located between the backing material layer 5 and adhesive layer 8, it must be additionally ensured that the retention force between the backing material layer 5 and the overprint layer 7 and between the overprint layer 7 and the adhesive layer 9 and additionally the internal cohesion of the overprint layer 7 and the internal cohesion of the adhesive layer are greater than the retention force of the adhesive layer 9 to the container surface 1, in order that neither delamination between the backing material layer 5 and the overprint layer 7 or the overprint layer 7 and the adhesive layer 9, nor cohesive destruction of the overprint layer 7 or the adhesive layer 9, and thereby the backing material layer 5, the overprint layer 7 and the adhesive layer 9 are detached as a unit from the container.

What is claimed is:

1. A label, which can be adhesively bonded to an article and detached again in a hot washing fluid, wherein the hot washing fluid is a liquid or its vapor, comprising:

a backing material layer having at least one stretched plastic film layer, which is stretched in at least one direction; and an adhesive layer to be bonded to the article, wherein the stretched plastic film layer is designed such that it shrinks back under the thermal effect of the hot washing fluid, overcoming the retention force of the adhesive layer bonded to the article, and the adhesive layer comprises adhesive which is substantially not dissoluble by the washing fluid at least until operational detachment of the label.

2. The label according to claim 1, wherein the adhesive layer is designed such that its retention force at the temperature of the washing fluid is lower than its retention force at ambient air temperature.

3. The label according to claim 1, wherein the adhesive layer is designed such that its viscosity at the temperature of the washing fluid is lower than its viscosity at ambient air temperature.

4. The label according to claim 1, wherein the shrinking force of the plastic film layer and the retention force of the adhesive layer are such that the label will be substantially completely detached from the container when the label is exposed to a washing liquid having a temperature of above 50° C., over a time of 1 to 6 minutes.

5. The label according to claim 1, wherein the adhesive layer and plastic film layer are designed such that the retention force of the adhesive layer to the backing material layer is higher than the detaching force caused by shrinkage of the plastic film layer, so that on detachment of the label from the article the adhesive layer remains on the label.

6. The label according to claim 1, wherein an overprint layer is located between the backing material layer and the adhesive layer, and the backing material layer the overprint layer and the adhesive layer are designed such that the retention force of the backing material layer to the overprint layer and the retention force of the overprint layer to the adhesive layer is greater than the detaching force caused by shrinkage of the backing material layer, so that on detachment of the label from the container the overprint layer and the adhesive layer remain on the label.

7. The label according to claim 1, wherein the adhesive layer comprises a redispersible pressure-sensitive adhesive which is designed such that it is substantially not dissoluble by the washing fluid at least until detachment of the label.

8. The label according to claim 1, wherein the adhesive layer comprises a dispersion adhesive based on acrylate, copolymeric acrylate/polyurethane compounds, or copolymers with acrylate component.

9. The label according to claim 1, wherein the adhesive layer is applied essentially over the full surface of the article or with gaps.

10. The label according to claim 1, wherein the label bears an overprint above or below the backing material layer and is transparent in regions free of the overprint.

11. The label according to claim 1, wherein the backing material layer is a single-layer film or comprises a plurality of coextruded partial layers and bears on its top or bottom side an overprint layer, directly or via an adhesion promoter layer.

12. The label according to claim 1, wherein the backing material layer has at least two partial layers, which include between them an overprint layer.

13. The label according to claim 12, wherein the overprint layer is printed directly on one of the two partial layers and is bonded to the other partial layer via a lamination adhesive layer.

14. The label according to claim 1, wherein the label serves for bonding onto a cylindrically curved surface of the article and its stretching direction or its main stretching direction extends in the circumferential direction of the article.

15. The label according to claim 1, wherein the label serves for bonding onto a cylindrically curved surface of the article and its stretching direction or its main stretching direction extends in a direction transverse to the circumferential direction of the article.

16. The label according to claim 1, wherein the backing material layer has only one single monoaxially or biaxially stretched plastic film layer.

17. The label according to claim 1, wherein the backing material layer has plurality of plastic film layers, each of which is stretched in substantially the same direction.

18. The label according to claim 17, wherein the plurality of plastic film layers are coextruded, or are produced individually and bonded to one another by means of a lamination adhesive.

19. The label according to claim 1, wherein the backing material layer has a plurality of plastic film layers, each of said film layers having a unique main stretching direction.

20. The label according to claim 17, wherein, of the plurality of plastic film layers, the layer closest to the adhesive layer is less intensively stretched than the other layers.

21. The label according to claim 1, wherein the backing material layer includes a first plastic film layer and a second plastic film layer, wherein the second plastic film layer is closer to the adhesive layer than the first layer and is monoaxially or biaxially stretched, the first layer is designed such that, when it is exposed to a hot washing fluid, it remains substantially dimensionally stable, and the second plastic film layer is designed such that it shrinks back when exposed to the hot washing fluid.

22. The label according to claim 21, wherein the plurality of plastic film layers are bonded to one another by means of a lamination adhesive.

23. The label according to claim 1, wherein the degree of shrinkage of the at least one plastic film layer, at least in the main shrinkage direction, under heating by the hot washing fluid, is greater than about 5%.

24. The label according to claim 1, wherein the at least one plastic film layer is produced from monoaxially or biaxially stretched polyethylene terephthalete (PET) or polyvinyl chloride (PVC) film.

25. The label according to claim 1, wherein the label layer bearing the adhesive layer is treated before application of the adhesive layer so as to improve adhesion, wherein the treatment includes one or more of the following: corona treatment, flame pretreatment, plasma pretreatment or chemical grafting.

26. The label according to claim 1, wherein the backing material layer bears an overprint on its top side.

27. The label according to claim 26, wherein the overprint is covered at its top side by a protective layer, wherein the protective layer comprises at least one of a lamination film and a protective lacquer.

28. A container provided with a label according to claim 1.

29. The label of claim 1, wherein an adhesion promoter is disposed between the stretched plastic film layer and the adhesive layer.

30. The label of claim 29, wherein the adhesion promoter comprises low molecular-weight, chlorinated polyolefins, a composition comprising chlorinated rubber, ethylene/vinyl acetate (EVA) copolymers and chlorinated polypropylene, and/or ethylene/acrylamide comonomers.

31. The label of claim 1, wherein the washing fluid comprises a washing liquid that comprises water and caustic soda.

32. The label of claim 1, wherein the adhesive layer (9) comprises a readily dispersible adhesive.

33. The label of claim 32, wherein the readily dispersible adhesive comprises aqueous acrylate dispersions.

34. The label of claim 33, wherein the readily dispersible adhesive comprises adhesives with a high proportion of dispersion aids or emulsifiers.

35. A method for detaching a label from an article, wherein the label comprises:

- a shrinkable plastic film layer, wherein the plastic film layer was stretched in a first direction; and
- an adhesive layer, wherein
  - the plastic film layer shrinks in a direction opposite to the first direction when the plastic film layer is exposed to a hot washing liquid or its vapor, thereby overcoming the retention force of the adhesive layer, and
  - the adhesive layer comprises an adhesive that is substantially insoluble in the hot washing liquid and/or vapor at least until operational detachment of the label from the article,
  - the method comprising the steps of:
    - heating a washing liquid, thereby forming the hot washing liquid and/or vapor; and
    - gradually detaching the label from the article, wherein said step of gradually detaching the label from the article comprises the step of exposing said label to the hot washing liquid and/or vapor for at least a predetermined amount of time so that the plastic film layer shrinks in the direction opposite to the first direction.

36. The method of claim 35, wherein the washing liquid comprises caustic soda.

37. The method of claim 35, wherein the hot washing liquid and/or vapor has a temperature in the range of about 50 to 90 degrees centigrade.

38. The method of claim 35, wherein an adhesion promoter is disposed between the stretched plastic film layer and the adhesive layer.

39. The method of claim 38, wherein the adhesion promoter comprises low molecular-weight, chlorinated polyolefins, a composition comprising chlorinated rubber, ethylene/vinyl acetate (EVA) copolymers and chlorinated polypropylene, and/or ethylene/acrylamide comonomers.

40. The method of claim 35, wherein the adhesive layer comprises a readily dispersible adhesive.

41. The method of claim 40, wherein the readily dispersible adhesive comprises aqueous acrylate dispersions.

42. The method of claim 40, wherein the readily dispersible adhesive comprises adhesives with a high proportion of dispersion aids or emulsifiers.

43. The method of claim 35, wherein the adhesive layer is added to the label only immediately before applying the label to the article.

44. The method of claim 35, wherein the label further comprises a second plastic film layer, wherein the first plastic film layer is disposed between the adhesive layer and the second plastic film layer.

45. The method of claim 44, wherein the second plastic film layer is a shrinkable, stretched plastic film layer.

46. The method of claim 44, wherein the first and second plastic film layers are bonded to one another by a lamination adhesive or coextruded.

47. A label, which can be detachably bonded to an article, comprising:

a backing material layer having a first plastic film layer, which is stretched in a first direction, and a second plastic film layer;

an adhesive layer for bonding the label to the article, the adhesive layer comprising an adhesive that is substantially insoluble in a hot washing liquid or its vapor; and an overprint layer, wherein the first plastic film layer is designed such that it shrinks in a direction opposite to the first direction when exposed to the liquid or vaporous hot washing fluid, the overprint layer is disposed between the first plastic film layer and the second plastic film layer, the first plastic film layer is disposed between said overprint layer and said adhesive layer, and the overprint layer is printed directly on the first plastic film layer and is bonded to the second plastic film layer by a lamination adhesive layer.

48. A label, which can be detachably bonded to an article, comprising:

a backing material layer having a first plastic film layer, which is stretched in a first direction, and a second plastic film layer, which is stretched in a second direction; and an adhesive layer for bonding the label to the article, the adhesive layer comprising an adhesive that is substantially insoluble in a hot washing liquid or its vapor, wherein the first plastic film layer is disposed between the second plastic film layer and the adhesive layer, the first plastic film layer is designed such that it shrinks in a direction opposite to the first direction when exposed to the hot washing liquid or vapor, the second plastic film layer is designed such that it shrinks in a direction opposite to the second direction when exposed to the liquid or vaporous hot washing fluid, and the second direction is substantially the same direction as the first direction.

49. The label according to claim 48, wherein the first and second plastic film layers are coextruded or produced individually and bonded to one another by a lamination adhesive.

50. The label according to claim 48, Wherein the first plastic film layer is less intensively stretched than the second plastic film layer.

51. A label, which can be detachably bonded to an article, comprising:

a backing material layer having a first plastic film layer, which is stretched in a first direction, and a second plastic film layer, which is stretched in a second direction; and an adhesive layer for bonding the label to the article, the adhesive layer comprising an adhesive that is substantially insoluble in a hot washing liquid or it vapor, wherein the first plastic film layer is disposed between the second plastic film layer and the adhesive layer, the first plastic film layer is designed such that it shrinks in a direction opposite to the first direction when exposed to the liquid or vaporous hot washing fluid, the second plastic film layer is designed such that it shrinks in a direction opposite to the second direction when exposed to the liquid or vaporous hot washing fluid, and the second direction is substantially different than the first direction.

52. The label according to claim 51, wherein the first plastic film layer is less intensively stretched than the second plastic film layer.

53. The label according to claim 51, wherein the first and second plastic film layers are coextruded or produced individually and bonded to one another by a lamination adhesive.

54. A label, which can be detachably bonded to an article, comprising:

a backing material layer having a first plastic film layer, which is monoaxially or biaxially stretched, and a second plastic film layer; and an adhesive layer for bonding the label to the article, the adhesive layer comprising an adhesive that is substantially insoluble in a hot washing liquid or its vapor, wherein the first plastic film layer is disposed between the second plastic film layer and the adhesive layer, the first plastic film layer is designed such that it shrinks when exposed to the hot washing fluid, and the second plastic film layer is designed such that it remains substantially dimensionally stable when exposed to the hot washing fluid.

55. The label according to claim 54, wherein the first and second plastic film layers are bonded to one another by a lamination adhesive.

* * * * *